US005286105A

United States Patent [19]

Herold et al.

[11] Patent Number: 5,286,105

[45] Date of Patent: Feb. 15, 1994

[54] APPARATUS FOR MIXING AND DISPENSING MULTIPLE-COMPONENT SUBSTANCES

[75] Inventors: Wolf D. Herold, Seefeld; Gerd Brandhorst, Munich; Guenther Rehfeld, Diessen, all of Fed. Rep. of Germany

[73] Assignee: Thera Patent GmbH & Co. KG Gesellschaft Fuer Industrielle Schutzrechte, Seefeld, Fed. Rep. of Germany

[21] Appl. No.: 811,440

[22] Filed: Dec. 23, 1991

[30] Foreign Application Priority Data

Dec. 21, 1990 [DE] Fed. Rep. of Germany ..... 9017322

[51] Int. Cl.[5] ..... B01F 15/02; B01F 7/00

[52] U.S. Cl. ..... 366/177; 366/279; 222/145; 222/137; 222/392

[58] Field of Search ..... 366/150, 162, 152, 177, 366/189, 178, 179, 182, 279; 222/145, 137, 333, 392

[56] References Cited

U.S. PATENT DOCUMENTS

| | | | |
|---|---|---|---|
| 3,279,653 | 10/1966 | Pfleger | 222/333 |
| 3,302,832 | 2/1967 | Hardman et al. | 222/145 |
| 3,570,719 | 7/1968 | Schiff | 222/145 |
| 3,581,575 | 6/1971 | Butler | 222/144.5 |
| 3,630,417 | 12/1971 | De Haas | 222/333 |
| 3,767,085 | 10/1973 | Cannon et al. | 222/145 |
| 3,774,816 | 11/1973 | Bratton | 222/145 |
| 3,884,228 | 5/1975 | Hahn | 604/245 |
| 4,024,994 | 5/1977 | Davis, Jr. | 222/333 |
| 4,067,479 | 1/1978 | Moline | 222/137 |
| 4,322,022 | 3/1982 | Bergman | 222/333 |
| 4,934,827 | 6/1990 | Taschke et al. | 366/162 |
| 5,004,351 | 4/1991 | Salaba et al. | 366/152 |
| 5,020,693 | 6/1991 | Ernst et al. | 222/137 |
| 5,104,005 | 4/1992 | Schneider, Jr. et al. | 222/145 |

FOREIGN PATENT DOCUMENTS

| | | | |
|---|---|---|---|
| 057465 | 9/1984 | European Pat. Off. . | |
| 0313519 | 4/1989 | European Pat. Off. | 222/145 |
| 3723517 | 1/1989 | Fed. Rep. of Germany . | |
| 3811954 | 10/1989 | Fed. Rep. of Germany | 222/333 |

*Primary Examiner*—Harvey C. Hornsby
*Assistant Examiner*—Tony G. Soohoo
*Attorney, Agent, or Firm*—Foley & Lardner

[57] ABSTRACT

An apparatus for mixing and dispensing two-component substances comprises two cartridges 12, 13 with pistons 15, 16 which are displaceable in the cartridges and are advanced in common by an electrical motor via a magnetic clutch 30. When the motor is switched off and the clutch 30 disengaged, the pistons 15, 16 may be manually retracted and re-advanced by means of a handwheel 33. At the end of the manual retracting motion, the pistons 15, 16 entrain a shaft 18 which serves to drive a mixer head 14, so that when the pistons 15, 16 become free of the cartridges 12, 13, the shaft 18 disengages from the mixer head 14. The cartridges 12, 13 including the mixer head 14 connected thereto may then be removed as a unit from the apparatus and replaced by another unit in order to exchange the emptied cartridges or, with the cartridges being still filled partially, to use the apparatus for preparing a different substance. Although the motor drive is designed for moving the pistons 15, 16 slowly, the manual retracting and advancing of the pistons renders an exchange of the cartridges rapid and unproblematic.

10 Claims, 3 Drawing Sheets

APPARATUS FOR MIXING AND DISPENSING MULTIPLE-COMPONENT SUBSTANCES

BACKGROUND OF THE INVENTION

This invention relates to an apparatus for mixing and dispensing multiple-component substances, which comprises a housing for receiving at least two cartridges each containing a component, and a mixer head connected to the cartridges, a shaft for rotating a mixer element disposed in the mixer head, and pistons which are connected via a clutch to a drive motor for discharging the cartridges and which are adapted to be retracted at a speed higher than the advancing speed.

An apparatus of this type is known from German Offenlegungsschrift 3,723,517. There, the pistons for dispensing the cartridges are driven by the same motor as drives the shaft of the mixer element. The cartridges contain the component to be mixed, e.g. components of an adhesive which react chemically with each other and cure within a short time. When the cartridges are empty, the pistons are retracted by opposite rotation of the driving motor, whereupon the cartridges may be removed and replaced by fresh ones. While the known apparatus provides a high-speed retracting motion, the exchange of cartridges still requires rather time-consuming manipulation.

If it is intended to exchange the cartridges in a partly filled condition in order to use the same apparatus for mixing and dispensing a different substance, it is likewise required to retract the pistons by reverse rotation of the motor. After the new cartridges have been inserted, which may also be partly filled, the pistons are advanced by the regular slow movement, which take correspondingly long until they reach the contents of the cartridges. Further, as a result of this idle advancing movement, it will be difficult in practice exactly to meter the first partial amount of the new substance to be discharged.

European Patent Specification 0,057,465 discloses another apparatus for mixing and dispensing two-component substances in which the mixer head is detachable so that the same cartridges permit a plurality of individual quantities to be discharged with long interruptions in between. Prior to every new discharging step, the mixer head with the old mixture hardened therein is removed and replaced by a new mixer head.

In this device, the pistons are advanced within the cartridges by piston rods in the form of threaded spindles each of which is driven by a pinion carrier. When a cartridge is empty, one end of the piston rod will be at the foremost end of the cartridge, while the other end will project only slightly from the rear end of the pinion carrier. After a new, full cartridge has been inserted, the pinion carrier is reversed and replaced in such a manner that now the short end of the piston rod acts on the piston disposed in the cartridge. A time-consuming screwing-back of the piston rods is thus avoided.

Even in this device, however, there is the problem, that, when partially filled cartridges are exchanged, the piston rods will have to be rotated with respect to the pinion carriers either manually or by reversing the drive motor to bring them into engagement with the pistons inside the new cartridges. Unless this condition is exactly met, an idle advancing movement will occur when the apparatus is next operated, which results in an undesirable change of the relationship between the operating time and the amount of mixture being dispensed, possibly also of the mixing ratio between the two components.

SUMMARY OF THE INVENTION

It is an object of the present invention to provide an apparatus for mixing and dispensing multiple-component substances which permit a rapids and easy exchange of the cartridges containing the substances, even when the cartridges are partly filled.

This object is met by an apparatus for mixing and dispensing multiple-component substances which comprises a housing for receiving at least two cartridges each containing a component, and a mixer head connected to the cartridges, a shaft for rotating a mixer element disposed in the mixer head, pistons which are connected via a clutch to a drive motor for discharging the cartridges and which are adapted to be retracted at a speed higher than the advancing speed, and handle means accessible from outside the housing for manually retracting and advancing the pistons when the clutch is disengaged.

In the apparatus of the present invention, the motor drive (which is intentionally slow) is disengaged when the cartridges are to be exchanged, so that the pistons can be directly and manually retracted and re-advanced at a substantially higher speed. After the fresh cartridges have been inserted, the pistons are manually advanced until they perceivably bear against the cartridge contents. Idle movements are thereby avoided in the subsequent motor-driven operation.

In a preferred embodiment, the clutch is a magnetic clutch adapted to be engaged and disengaged simultaneously with the switching on and off of the drive motor. Accordingly, manual piston operation is possible only when the drive motor is switched off. A further and very substantial advantage that results from simultaneously switching off the motor and disengaging the clutch resides in the fact that the pistons are relieved at the end of each dispensing action so that an undesirable after-flow of the components is avoided.

In a further development of the invention, the shaft is adapted to be disengaged from the mixer element by being axially displaced. This enables the cartridges and mixer head to be removed as a unit by a movement transverse of the advancing direction of the pistons.

According to another embodiment of the invention, the pistons are movable along a direction parallel to the shaft, and means are provided for positively moving the shaft out of engagement with the mixer element during the final part of the retracting motion of the pistons. Accordingly, when the pistons are manually retracted from the cartridges, the shaft is automatically disengaged from the mixer head without requiring additional manipulation. After a new set of cartridges has been inserted, resilient means will cause the shaft to be automatically re-coupled to the mixer head when the pistons are inserted into their cartridges.

The manual movement of the pistons is preferably done by means of a handwheel that is directly mounted on the output shaft of the clutch driving the pistons and thus permits direct manipulation of the pistons. In a further preferred embodiment, the pistons are directly interconnected and thus advanced and retracted in common.

In a further advantageous development of the invention, each piston is loosely coupled to the piston rod driving it so that it is free to center itself within the cartridge even when the piston rod is out of alignment with the cartridge axis. Such a lack of alignment may occur particularly when both pistons are commonly driven and high-viscosity substances are handled.

In still further preferred embodiments, guide means are disposed behind each cartridge for aligning each piston with respect to its cartridge, and each of these guide means has an inner cylindrical surface with a conical portion that opens outwardly towards the respective cartridge. Accordingly, the pistons are readily inserted into the rear cartridge ends notwithstanding their loose coupling to the piston rods.

DETAILED DESCRIPTION OF A PREFERRED EMBODIMENT

Figure 1:
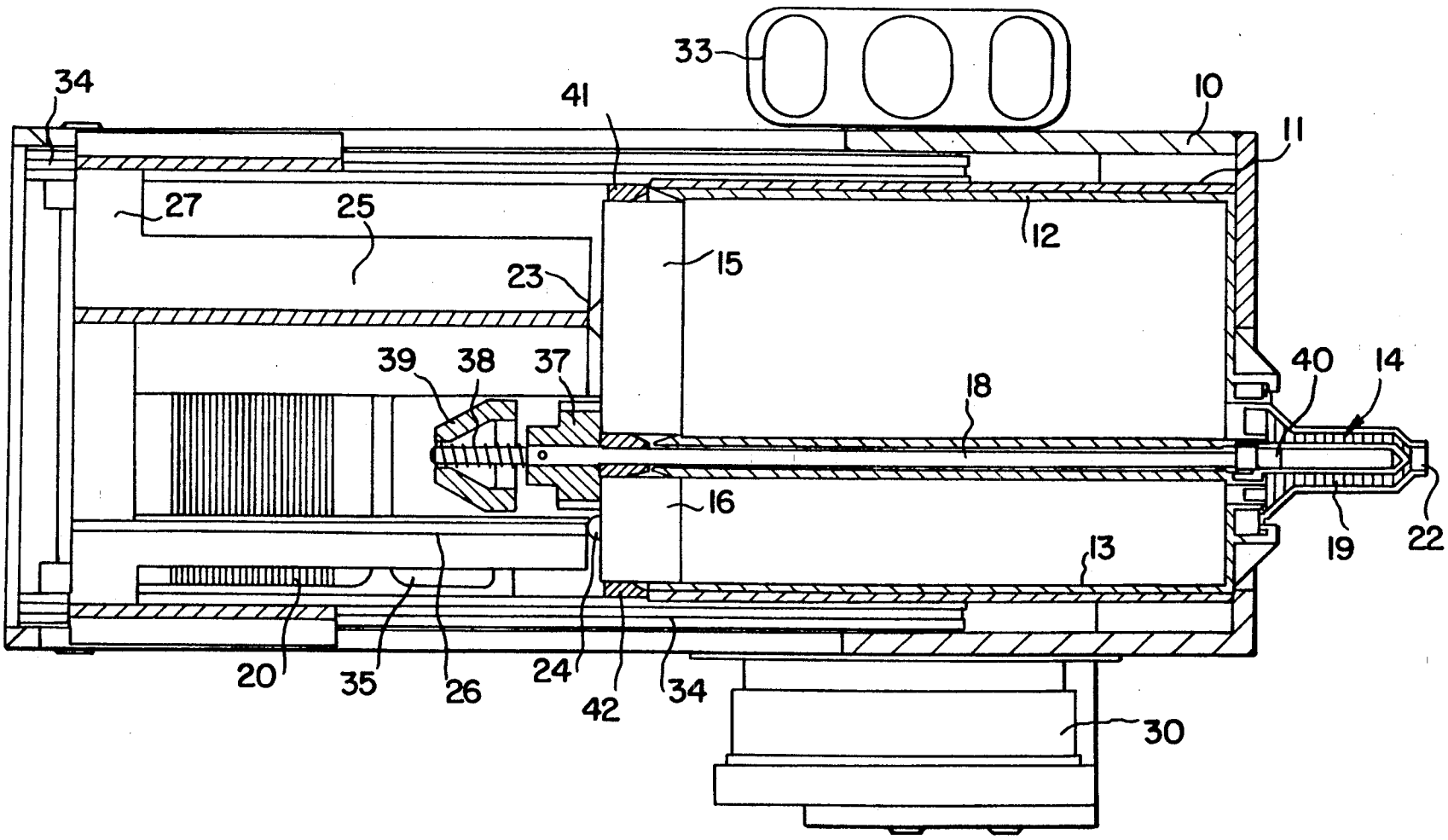
FIG. 1 is a horizontal longitudinal section through a mixing and dispensing apparatus, taken along the line I—I in FIG. 3.

The apparatus shown in the drawings includes a housing 10, a trough-shaped receptacle 11 for two adjacent parallel cartridges 12, 13 which have a mixer head 14 attached to their front ends, pistons 15, 16 movably disposed in the cartridges 12, 13, an electrical motor 17 for driving the pistons, a mixer rotating shaft 18 extending parallel to, and disposed between, the cartridges 12, 13 and having its front end engaging a mixer element 19 rotatably supported within the mixer head 14, and an electrical motor 20 for driving the shaft 18. The cartridges 12, 13 are shown with different diameters to illustrate an example where the components, with equal advancing speeds of the pistons 15, 16, are supplied to the mixer head 14 at a volume ratio different from 1:1.

The two pistons 15, 16 are connected via joints 23, 24 to piston rods 25, 26, respectively, which have cross- or L-shaped cross sections and are rigidly interconnected at their rear ends by a transverse member 27. The joints 23, 24 constitute loose couplings such that the pistons 15, 16 are pivotal and slightly movable in the lateral direction relative to their piston rods 25, 26. Due to this loose coupling, the pistons 15, 16 are self-centered within their cartridges 12, 13, so that they will not tilt and jam if the piston rods 25, 26 should become misaligned with respect to the cartridge axes during their advancing or retracting movements. This ensures easy piston movement.

The pistons 15, 16 are driven by the motor 17 via a reduction gear 28 and the input disk 29 of a magnetic clutch 30 the output disk 31 of which is keyed to an intermediate shaft 32. At its other end, the shaft 32 carries a handwheel 33 which is accessible from outside the housing 10. The shaft 32 drives a pair of chains 34 to which the transverse member 27 interconnecting the piston rods 25, 26 is fixed.

The shaft 18 is driven by the motor 20 via a gear drive 35, a pinion 36 fixed to the output shaft of the gear drive 35, and a pinion 37 meshing with the pinion 36 and fixed to the shaft 18.

Figure 3:
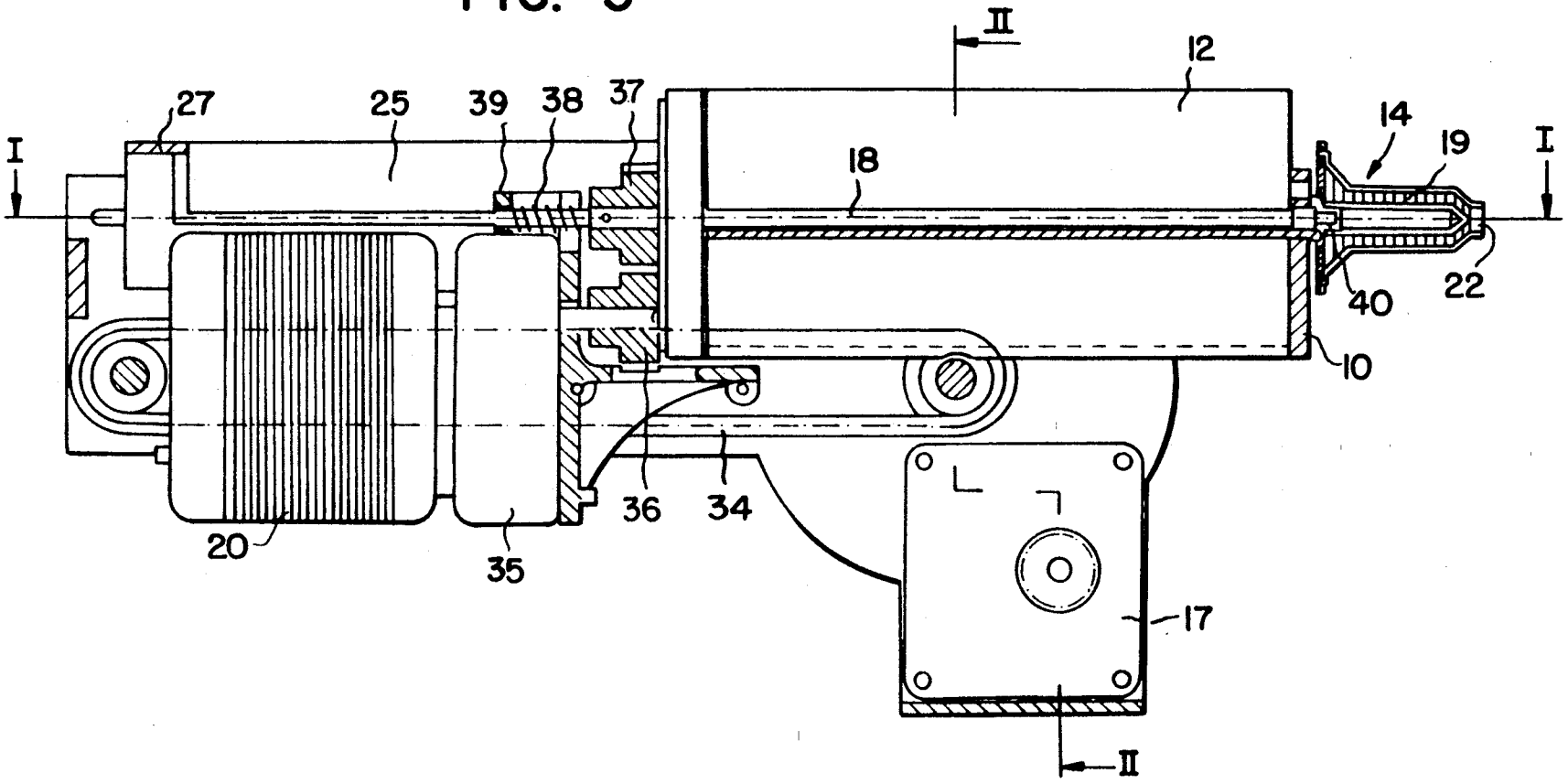
FIG. 3 is a vertical longitudinal section along the line III—III in FIG. 2.

The shaft 18 is mounted for axial sliding movement and is biassed in the direction of engagement with the mixer element 19 (i.e. to the right in FIGS. 1 and 3) by a compression spring 38 disposed between the pinion 37 and a rear mounting bracket 39. The teeth of the pinions 36, 37 have sufficient axial lengths to remain in meshing engagement even when the shaft 18 is moved to the left in FIGS. 1 and 3 by such a distance that a hexagonal portion 40 provided at the front end of the shaft 18 is moved out of engagement with the mixer element 19.

FIG. 1 shows the pistons 15, 16 in a position in which they just extend into the rear ends of the cartridges 12, 13. In this position, their rear end faces bear against the front face of the pinion 37. When the pistons 15, 16 are retracted further to the left in FIG. 1, they entrain the pinion 37 so that the shaft 18 is disengaged from the mixer element 19.

In the position shown in FIG. 1, the pistons 15, 16 are within sleeves 41, 42, respectively, which have inner cylindrical guide surfaces and open towards the cartridges 12, 13 by outwardly flaring conical surface portions. The sleeves 41, 42 serve to guide the pistons 15, 16, which are loosely coupled to the piston rods 25, 26, when the pistons are outside the cartridges 12, 13. They also facilitate an aligned insertion of the pistons into the cartridges. The conical surface portions further facilitate inserting the pistons 15, 16 into the sleeves 41, 42 in case the pistons are advanced with no cartridges present.

The components of the substance to be produced may be filled directly into the cartridges 12, 13, in which case the pistons 15, 16 act on displaceable members (not shown) which seal the cartridges rearwardly. In an alternative embodiment, the components may be contained in plastics bags which are inserted into the cartridges 12, 13 and discharged by means of the pistons 15, 16.

In operation, a unit consisting of filled cartridges 12, 13 and a mixer head 14 attached thereto is placed into the receptacle 11, and the pistons 15, 16 are then advanced by means of the handwheel 33 with the magnetic clutch 30 disengaged by such a distance that they bear against the rear end of the filling (i.e. the sealing members or plastics bags mentioned above). By means of a switch (not shown) both motors 17 and 20 are switched on and the clutch 30 is simultaneously engaged. The pistons 15, 16 are then slowly advanced within their cartridges 12, 13 so as to urge the two components into the mixer head 14. Simultaneous rotation of the mixer element 19 causes the components to be mixed to form a ready-to-use substance which is forced out of a dispensing opening 22 of the mixer head 14. After the desired amount has been dispensed, the apparatus is switched off. The pistons 15, 16 will then be at some intermediate position within the cartridges 12, 13.

Figure 2:
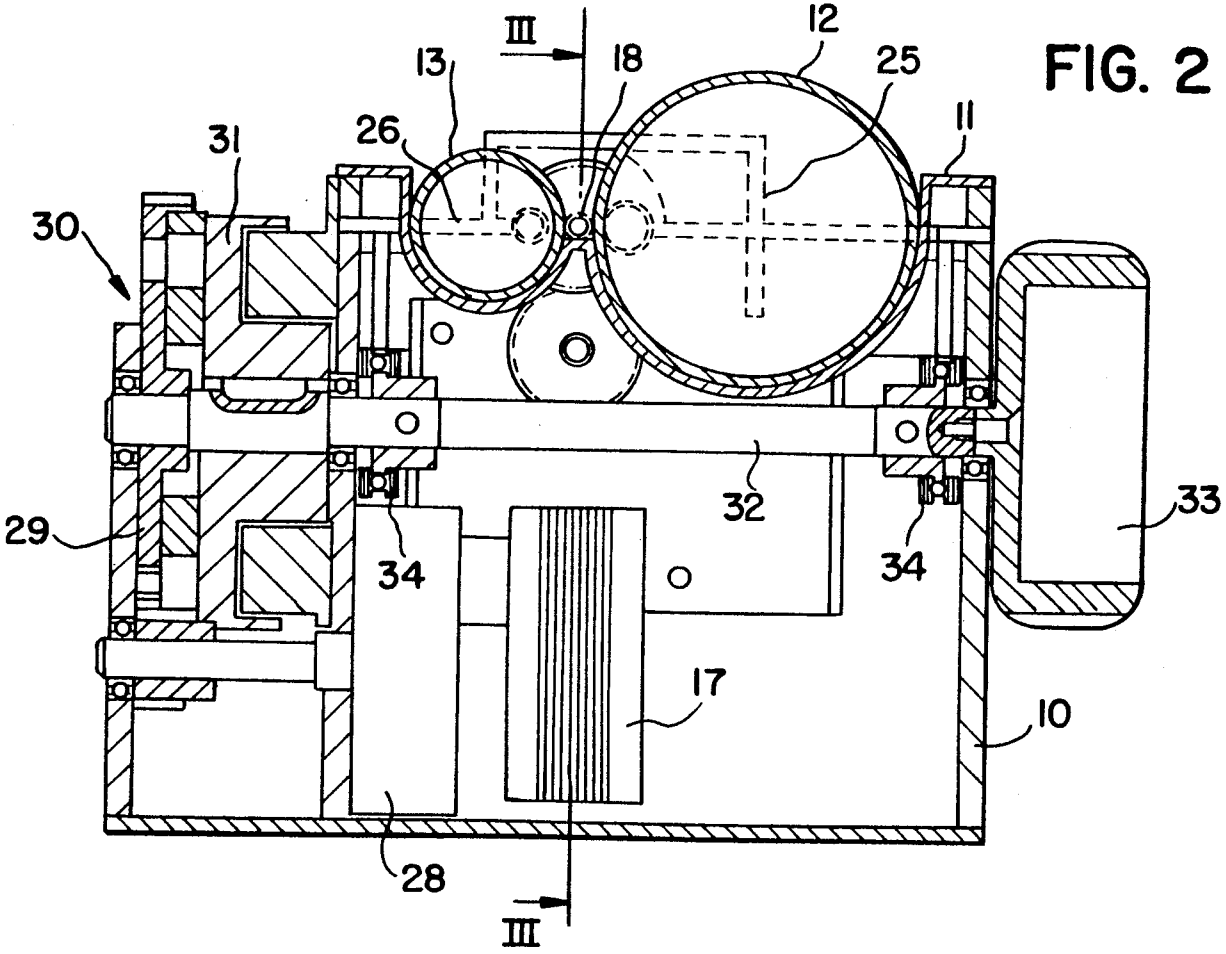
FIG. 2 is a vertical cross-sectional view taken along the line II—II in FIG. 3.

When it is intended to mix and dispense a different material with the same device, the pistons 15, 16 are retracted from the cartridges 12, 13 by rotating the handwheel 33. At the end of this retracting motion, the pistons 15, 16 entrain the pinion 37 to the left in FIG. 1 against the bias of the compression spring 38 so that the hexagonal portion 40 provided at the front end of the shaft 18 is disengaged from the mixer element 19. In this position, the unit consisting of the cartridges 12, 13 and the mixer head 14 is taken out of the device by a movement perpendicular to the advancing direction of the pistons 15, 16, i.e. upwardly in FIG. 2, and replaced by another set of cartridges and mixer head.

Due to the fact that the movement of the pistons 15, 16 when being retracted from the cartridges 12, 13 and re-advanced into new cartridges, is done manually by means of the handwheel 33 fixed to the intermediate shaft 32 which directly drives the chains 34 and thus the pistons 15, 16, this movement may be carried out at a high speed and in a readily perceivable manner. As a result, an exchange of the cartridges can be performed rapidly and by simple handling irrespective of whether the cartridges are partially filled (in case of using the device for preparing a different substance) or have been completely emptied and replaced by fresh cartridges.

What is claimed is:

1. An apparatus for mixing and dispensing multiple-component substances comprising:

a housing for receiving at least two cartridge means each containing one component, and a mixer connected to said cartridge means and having a mixer element disposed in said mixer;

means including a mixer rotating shaft for rotating said mixer element, said shaft having an axis and being adapted to be disengaged from said mixer element by being shifted along the shaft axis;

a drive motor;

a piston reciprocably disposed in each cartridge means and connected to said drive motor for emptying said cartridge means;

a clutch having an input shaft coupled to said motor and an output shaft coupled to said pistons;

handle means accessible from outside said housing for manually retracting and advancing said pistons when said clutch is disengaged, said pistons being movable along a direction parallel to the axis of said mixer rotating shaft, and means on said mixer rotating shaft engageable by said piston for positively moving said mixer rotating shaft out of engagement with said mixer element during a final part of the retracting motion of said pistons.

2. The apparatus of claim 1, wherein said clutch is a magnetic clutch adapted to be engaged and disengaged simultaneously with said drive motor being switched on and off.

3. The apparatus of claim 1, including resilient means for biasing said mixer rotating shaft into engagement with said mixer element.

4. The apparatus of claim 1, wherein said mixer rotating shaft is driven through a pair of pinions, one of which is mounted on said mixer rotating shaft, which are axially displaceable with respect to each other, the pinion mounted on said mixer rotating shaft having an abutment surface for engagement by said pistons.

5. The apparatus of claim 1, wherein said handle means is formed by a handwheel mounted on the output shaft of said clutch.

6. The apparatus of claim 1, wherein said pistons are interconnected for common advancement and retraction.

7. The apparatus of claim 1, wherein each said piston is loosely coupled to a piston rod connected to said drive motor.

8. The apparatus of claim 7, including guide means disposed at an end of each said cartridge means for aligning said piston with respect to said cartridge means.

9. The apparatus of claim 8, wherein each of said guide means has an inner cylindrical surface with a conical portion that opens outwardly towards the respective cartridge means.

10. An apparatus for mixing and dispensing multiple-component substances comprising:

a housing for receiving at least two cartridge means each containing one component;

a mixer connected to said cartridge means and including a mixer element;

means including a mixer rotating shaft adapted to engage said mixer element for rotating the same;

a drive motor;

a piston reciprocally disposed in each cartridge means and connected to said drive motor for emptying said cartridge means;

a clutch engageable and disengageable with said motor, said clutch having an input shaft coupled to said motor and an output shaft coupled to said pistons, and handle means accessible from outside said housing for manually retracting said pistons away from and advancing said pistons toward said cartridges when said clutch is disengaged, and wherein said mixer and cartridges form a unit which is adapted to be separated from said housing when said pistons are retracted from said cartridges and said mixer rotating shaft is disengaged from said mixer element.

* * * * *